US007343766B2

(12) United States Patent
Tsuritani

(10) Patent No.: US 7,343,766 B2
(45) Date of Patent: Mar. 18, 2008

(54) SPRING MANUFACTURING APPARATUS

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 65 days.

(21) Appl. No.: 11/455,728

(22) Filed: Jun. 20, 2006

(65) Prior Publication Data

US 2006/0283226 A1 Dec. 21, 2006

(30) Foreign Application Priority Data

Jun. 21, 2005 (JP) ..... 2005-181017

(51) Int. Cl.
*B21F 3/02* (2006.01)
*B21J 13/00* (2006.01)
*B21J 9/18* (2006.01)

(52) U.S. Cl. ..... 72/135; 72/140; 72/446; 72/452.1

(58) Field of Classification Search ..... 72/135, 72/140, 441, 442, 446, 450, 452.1, 452.8
See application file for complete search history.

(56) References Cited

U.S. PATENT DOCUMENTS 3,934,445 A * 1/1976 Lampietti ..... 72/129
5,657,657 A * 8/1997 Welsh et al. ..... 72/139
6,000,265 A 12/1999 Itaya
6,006,572 A * 12/1999 Tsuritani ..... 72/135
6,393,888 B1 5/2002 Sautter et al.

FOREIGN PATENT DOCUMENTS

JP 10-128484 A 5/1998
JP 2889553 B2 2/1999
JP 2000-317563 A 11/2000
JP 3286236 B2 3/2002

* cited by examiner

*Primary Examiner*—Derris H. Banks
*Assistant Examiner*—Teresa M Bonk
(74) *Attorney, Agent, or Firm*—Birch, Stewart, Kolasch & Birch, LLP

(57) ABSTRACT

A spring manufacturing apparatus with a reduced number of driving sources, yet capable of adjusting the relative positions among the bending dices with higher precision when manufacturing a spring is to be provided. A second bending dice mounting slider and a third bending dice mounting slider are symmetrically located about a center line extended from a moving direction of a first bending dice mounting slider. An arm mechanically connects the first bending dice mounting slider and the second bending dice mounting slider, or the first bending dice mounting slider and the third bending dice mounting slider, so that either of a driving source that drives the second bending dice mounting slider or a driving source that drives the third-bending dice mounting slider moves the first bending dice mounting slider, thus to determine a winding direction of a wire for manufacturing a spring.

4 Claims, 6 Drawing Sheets

A

B

SPRING MANUFACTURING APPARATUS

CROSS-REFERENCE TO RELATED APPLICATIONS

This Nonprovisional application claims priority under 35 U.S.C.§119(a) on Patent Application No. 2005-181017 filed in Japan on Jun. 21, 2005, the entire contents of which are hereby incorporated by reference.

BACKGROUND OF THE INVENTION

The present invention relates to a spring manufacturing apparatus with a reduced number of driving sources, yet capable of precisely bending the spring.

A conventional spring manufacturing apparatus has a wire processing space where the wire is formed into a spring, defined by a front wall of a casing. The spring manufacturing apparatus includes at least a pair of wire feeding rollers that delivers the wire to the wire processing space, via a wire path. The wire fed into the wire processing space is bent by a bending dice mounted on three bending dice mounting sliders, installed so as to move into and out of the wire processing space.

The three bending dice mounting sliders are located on the wire path at a position opposing the outlet of the wire, and symmetrically with respect to a center line extended from the wire path. The three bending dice mounting sliders are respectively provided with a motor serving as a driving source. Controlling the rotation of the motor so as to locate the bending dice mounting sliders at a desired relative position enables forming the spring in a desired shape.

The spring manufacturing apparatus thus structured, however, requires a motor for each of the three bending dice mounting sliders for the positioning. Accordingly, it is difficult to reduce the manufacturing cost, and hence the running cost remains high. From such viewpoint, a spring manufacturing apparatus with a single driving source that drives the bending dice mounting sliders has been developed. In such spring manufacturing apparatus, the driving source directly drives a first bending dice mounting slider. The remaining bending dice mounting sliders are mechanically linked with the first bending dice mounting slider and provided with a removable arm, so that the bending dice mounting sliders necessary for manufacturing the spring can be driven.

BRIEF SUMMARY OF THE INVENTION

In the spring manufacturing apparatus including a single driving source that drives the bending dice mounting sliders, the first bending dice mounting slider directly driven by the driving source can be linearly moved with a ball screw directly attached to the rotating shaft of the driving source. The other bending dice mounting sliders are mechanically linked with the first bending dice mounting slider via the arm, which swings according to the linear motion of the first bending dice mounting slider. The center of the swinging motion of the arm is located at a middle point between the first bending dice mounting slider and the other bending dice mounting sliders linked thereto, and hence the other bending dice mounting sliders can only move along an arc created by the swinging motion of the arm. Accordingly, the other bending dice mounting sliders cannot be moved at the same speed as the first bending dice mounting slider, and therefore it is difficult to improve manufacturing precision over a certain level when manufacturing a spring with a variable outer diameter.

The present invention has been conceived in view of the foregoing situation, with an object to provide a spring manufacturing apparatus in which the first bending dice mounting slider is linked with the other bending dice mounting sliders thus to reduce the number of driving sources, and which is capable of adjusting the relative positions among the bending dices with higher precision, when manufacturing a spring.

Another object of the present invention is to provide a spring manufacturing apparatus including an arm that swings over a rotation radius longer than a spacing among the linked bending dice mounting sliders, so as to create more accurate approximation line of the movement of the bending dice mounting sliders caused by the swinging motion of the arm.

Still another object of the present invention is to provide a spring manufacturing apparatus including a groove cam mechanism, so that the moving direction of the bending dice, caused by the movement of the bending dice mounting slider, can be linearly approximated upward or downward by a predetermined angle.

To achieve the foregoing objects, a first aspect of the present invention provides a spring manufacturing apparatus comprising a wire path through which a wire passes to enter a wire processing space for forming the wire into a spring by using a bending dice; at least a pair of wire feeding rollers that pressingly holds the wire and feeds the wire to the wire processing space; and a first, a second and a third bending dice mounting slider disposed so as to move into and out of the wire processing space; in which the first bending dice mounting slider is located at a position opposing an outlet of the wire path, and the second and the third bending dice mounting sliders are symmetrically located with respect to a center line along the moving direction of the first bending dice mounting slider; further comprising an arm that mechanically connects the first and the second bending dice mounting slider, or the first and the third bending dice mounting slider selectively; a first driving source that drives the second bending dice mounting slider; and a second driving source that drives the third bending dice mounting slider; wherein one of the first and the second driving source, selected according to which bending dice mounting sliders are connected by the arm, causes the first bending dice mounting slider to move in an interlocked manner so as to determine a winding direction of the wire for manufacturing a spring.

A second aspect of the present invention provides a spring manufacturing apparatus according to the first aspect, wherein the arm has a center of a swinging motion thereof on an extension of a line connecting the mechanically connected portion between the first and the second bending dice mounting slider, or between the first and the third bending dice mounting slider.

A third aspect of the present invention provides a spring manufacturing apparatus according to the first and the second aspect, in which the first bending dice mounting slider comprises a swinging member with a bending dice attached to an end portion, disposed so as to swing about the other end portion located close to a generally central portion of the first bending dice mounting slider; a block with a cam groove formed above and below the first bending dice mounting slider; and a cam mechanism including a slider that fits in the cam groove; wherein one of the block and the slider is connected to the swinging member.

According to the first aspect, the first bending dice mounting slider is located at a position opposing the wire outlet of the wire path, and the second and the third bending dice mounting slider are symmetrically located with respect to a center line along the moving direction of the first bending dice mounting slider. The first and the second bending dice mounting slider, or the first and the third bending dice mounting slider are selectively connected by the removable arm. When the first and the second bending dice mounting slider are connected by the arm, the driving source that drives the second bending dice mounting slider is activated to cause the first bending dice mounting slider to move in an interlocked manner, to thereby determine the winding direction of the wire for manufacturing the spring. When the first and the third bending dice mounting slider are connected by the arm, the driving source that drives the third bending dice mounting slider is activated to cause the first bending dice mounting slider to move in an interlocked manner, to thereby wind the wire in the opposite direction for manufacturing the spring.

Such configuration requires only two driving sources that drive the bending dice mounting sliders, thus allowing reducing power consumption compared to the apparatus with three driving sources. Also, selectively switching the bending dice mounting slider to be connected by the arm determines the winding direction of the wire.

Further, in the spring manufacturing apparatus with a single driving source, the second bending dice mounting slider has to be moved in an interlocked manner at a constant speed, for example when manufacturing a spring with a progressively increasing outer diameter. However, it is difficult to cause the bending dice mounting slider not directly driven by the driving source to move at a constant speed. In contrast, according to the first aspect the first bending dice mounting slider is directly driven by one of the driving sources, and the other bending dice mounting sliders are indirectly driven by the other driving source. Therefore, numerically controlling the rotation of the driving sources permits moving the both bending dice mounting sliders at a constant speed, thus enabling manufacturing the spring with higher precision, even when the spring has a progressively increasing outer diameter.

According to the second aspect, the arm has the center of the swinging motion thereof on an extension of the line connecting the mechanically connected portion between the first and the second bending dice mounting slider, or between the first and the third bending dice mounting slider. Such structure provides a larger rotation radius to the arm, to thereby make the swinging motion of the arm, caused by for instance the third bending dice mounting slider, closer to a linear motion. The second aspect, therefore, allows the first bending dice mounting slider to linearly move at a constant speed with higher precision, resulting in more precise manufacturing of springs in various shapes.

According to the third aspect, the first bending dice mounting slider is provided with a swinging member with a bending dice attached to an end portion, disposed so as to swing about the other end portion located close to a generally central portion of the first bending dice mounting slider. The first bending dice mounting slider is also provided with a block with a cam groove formed above and below the first bending dice mounting slider, and a cam mechanism including a slider that fits in the cam groove, such that one of the block and the slider is connected to the swinging member. Such structure permits causing the bending dice to linearly move upward or downward by a predetermined angle, interlocked with the first bending dice mounting slider which is not provided with the driving source, by the swinging motion of the swinging member.

The first aspect requires only two driving sources that drive the bending dice mounting sliders, thus allowing reducing power consumption compared to the apparatus with three driving sources. Also, selectively switching the bending dice mounting slider to be connected by the arm determines the winding direction of the wire.

Further, in the spring manufacturing apparatus with a single driving source, the second bending dice mounting slider has to be moved in an interlocked manner at a constant speed, for example when manufacturing a spring with a progressively increasing outer diameter. However, it is difficult to cause the bending dice mounting slider not directly driven by the driving source to move at a constant speed. In contrast, according to the first aspect the first bending dice mounting slider is directly driven by one of the driving sources, and the other bending dice mounting sliders are indirectly driven by the other driving source. Therefore, numerically controlling the rotation of the driving sources permits moving the both bending dice mounting sliders at a constant speed, thus enabling manufacturing the spring with higher precision, even when the spring has a progressively increasing outer diameter.

The structure according to the second aspect provides a larger rotation radius to the arm, to thereby make the swinging motion of the arm, caused by for instance the third bending dice mounting slider, closer to a linear motion. The second aspect, therefore, allows the first bending dice mounting slider to linearly move at a constant speed with higher precision, resulting in more precise manufacturing of springs in various shapes.

The structure according to the third aspect permits causing the bending dice to linearly move upward or downward by a predetermined angle, together with the first bending dice mounting slider which is not provided with the driving source, by the swinging motion of the swinging member, resulting in more precise manufacturing of springs in various shapes.

The above and further objects and features of the invention will more fully be apparent from the following detailed description with accompanying drawings.

DETAILED DESCRIPTION OF THE INVENTION

Figure 1:
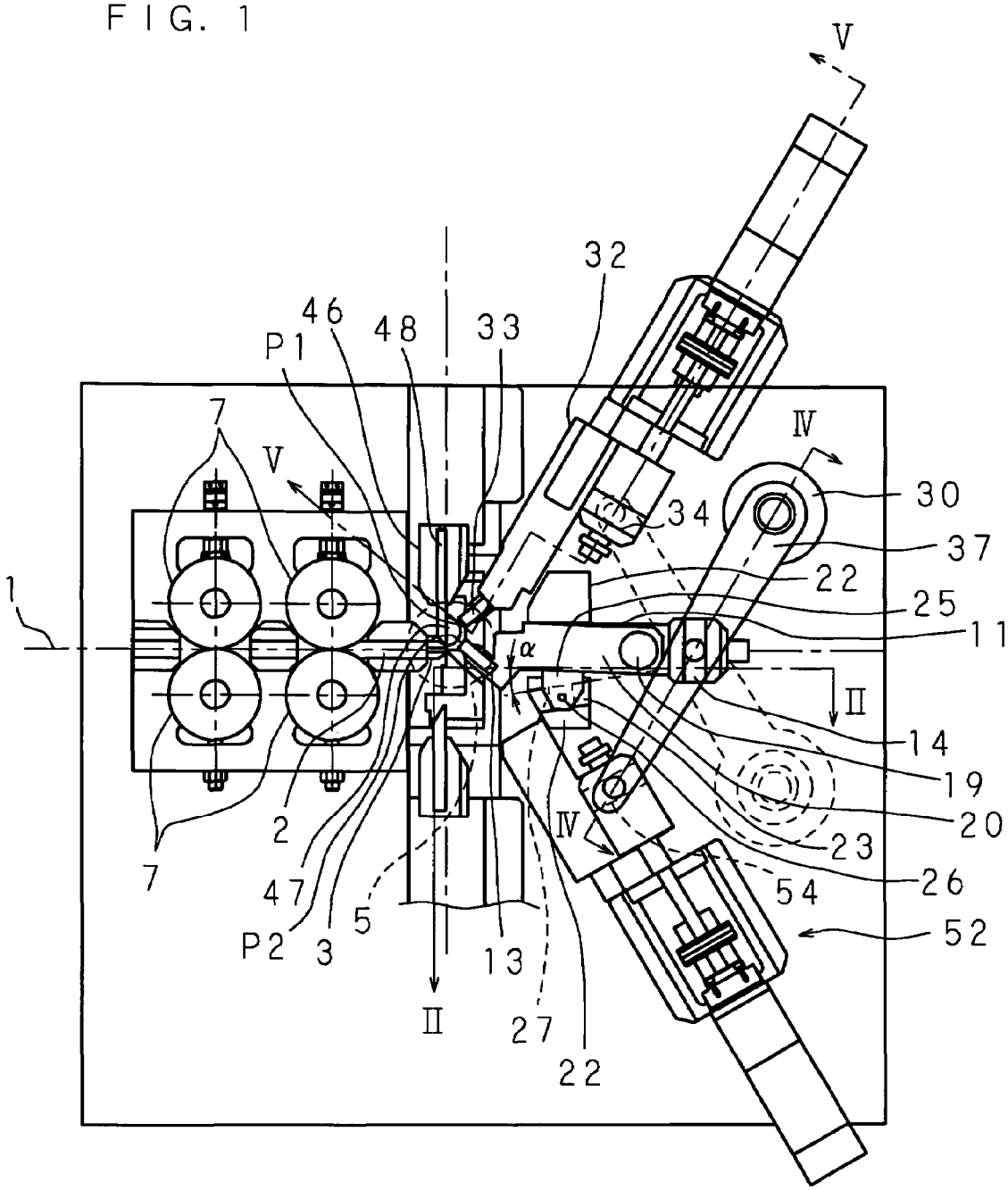
FIG. 1 is a front view showing a main portion of a spring manufacturing apparatus according to an embodiment of the present invention.

Hereunder, the present invention will be described based on the drawings showing an embodiment thereof. FIG. 1 is a front view showing a main portion of a spring manufacturing apparatus according to an embodiment of the present invention.

As shown in FIG. 1, in the spring manufacturing apparatus according to the embodiment, a wire 1 is led to two pairs of wire feeding rollers 7, 7, . . . each including an upper and a lower roller. In the wire feeding rollers 7, 7, . . . , the upper rollers 7, 7 rotate counterclockwise, and the lower rollers 7, 7 rotate clockwise, thus to feed the wire 1 to the wire path 2.

The wire 1 led to an end portion of the wire path 2 is introduced to a wire processing space 5, to be butted to, for example, bending dices 13, 33 mounted on a tip portion of a first bending dice mounting slider 11 and a second bending dice mounting slider 32, respectively. The wire 1 is bent and deformed in a desired direction according to an angle and relative positions of the bending dices 13, 33 to which the wire 1 is butted, to be wound in a desired spring shape.

A cutting tool slider 46, with a cutter 48 fixed to an end portion thereof, is provided for cutting the wound spring in cooperation with a core bar 47 projecting from a front wall. The cutting tool slider 46 moves up and down into and out of the wire processing space 5 along a guardrail (not shown) so as to hold the wire 1 between the cutter 48 and the core bar 47, and the cutter 48 descends until slidingly contacting the core bar 47, thus to cut the wire 1.

Figure 2:
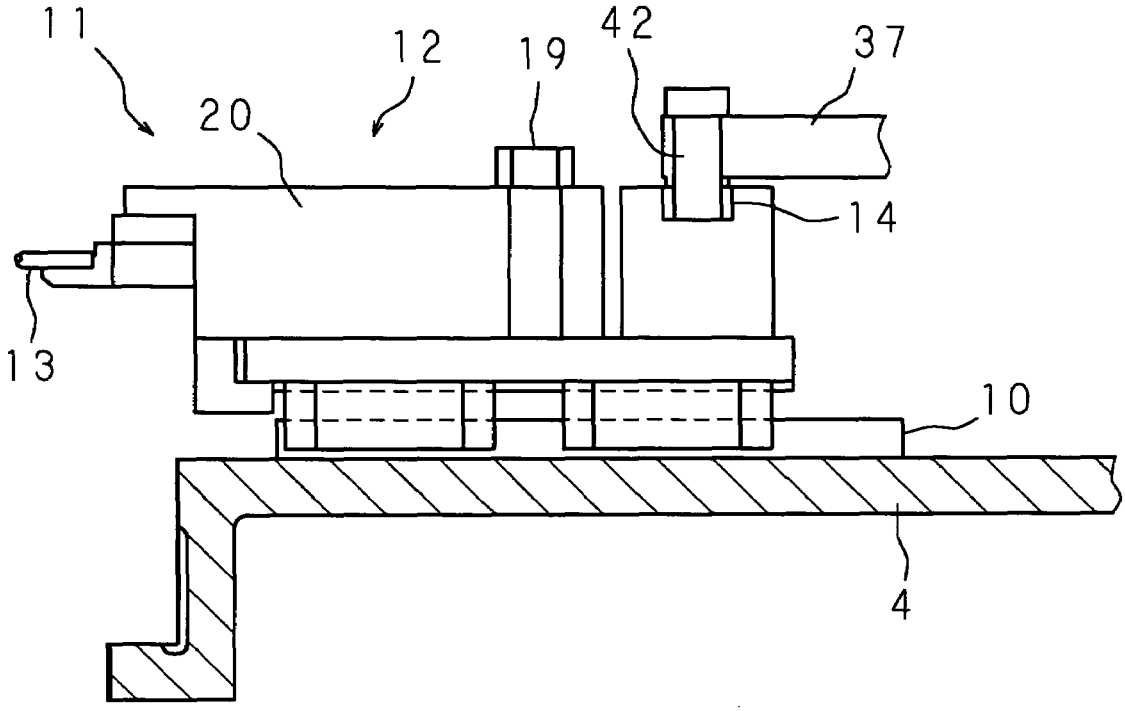
FIG. 2 is a cross-sectional view taken along the line II-II of FIG. 1, showing a structure of a first bending dice mounting slider.

The first bending dice mounting slider 11 is located at a position opposing the outlet of the wire 1 of the wire path 2 across the wire processing space 5. FIG. 2 is a cross-sectional view taken along the line II-II of FIG. 1, showing a structure of the first bending dice mounting slider.

The first bending dice mounting slider 11 includes a guide rail 10 placed on the front wall 4 in a direction of an extension of the center line of the wire in the wire path 2, so that the slider main body 12 can slide along the guide rail 10, back and forth with respect to the wire processing space 5. At the tip portion of the slider main body 12 the bending dice 13 is attached, for bending the wire 1 in the wire processing space 5.

The slider main body 12 is not provided with a direct driving source. The slider main body 12 is driven interlocked with a movement of a second bending dice mounting slider 32 or a third bending dice mounting slider 52 to be described later, by an arm 37, also to be described later, swingably attached to a generally vertical plane parallel to the front wall 4. Accordingly, motors M2, M3 serving as driving sources are connected to the second bending dice mounting slider 32 or the third bending dice mounting slider 52 respectively.

The slider main body 12 includes a groove 14 for a second projection 42 of the arm 37 to be fitted in. When the motor M2 or M3 serving as the driving source rotates to move the second bending dice mounting slider 32 or the third bending dice mounting slider 52, the second projection 42 slides along the groove 14, so that the first bending dice mounting slider 11 moves interlocked therewith.

Here, the slider main body 12 includes a swinging member 20 that can swing about an axle 19 perpendicularly oriented with respect to the front wall 4. The winging member 20 is interlocked with a cam mechanism 21, such that when the second bending dice mounting slider 11 horizontally moves away from the wire processing space 5 the slider main body 12 is caused to swing upward by the swinging member 20, so that the bending dice 13 attached to the tip portion swings upward.

Figure 3:
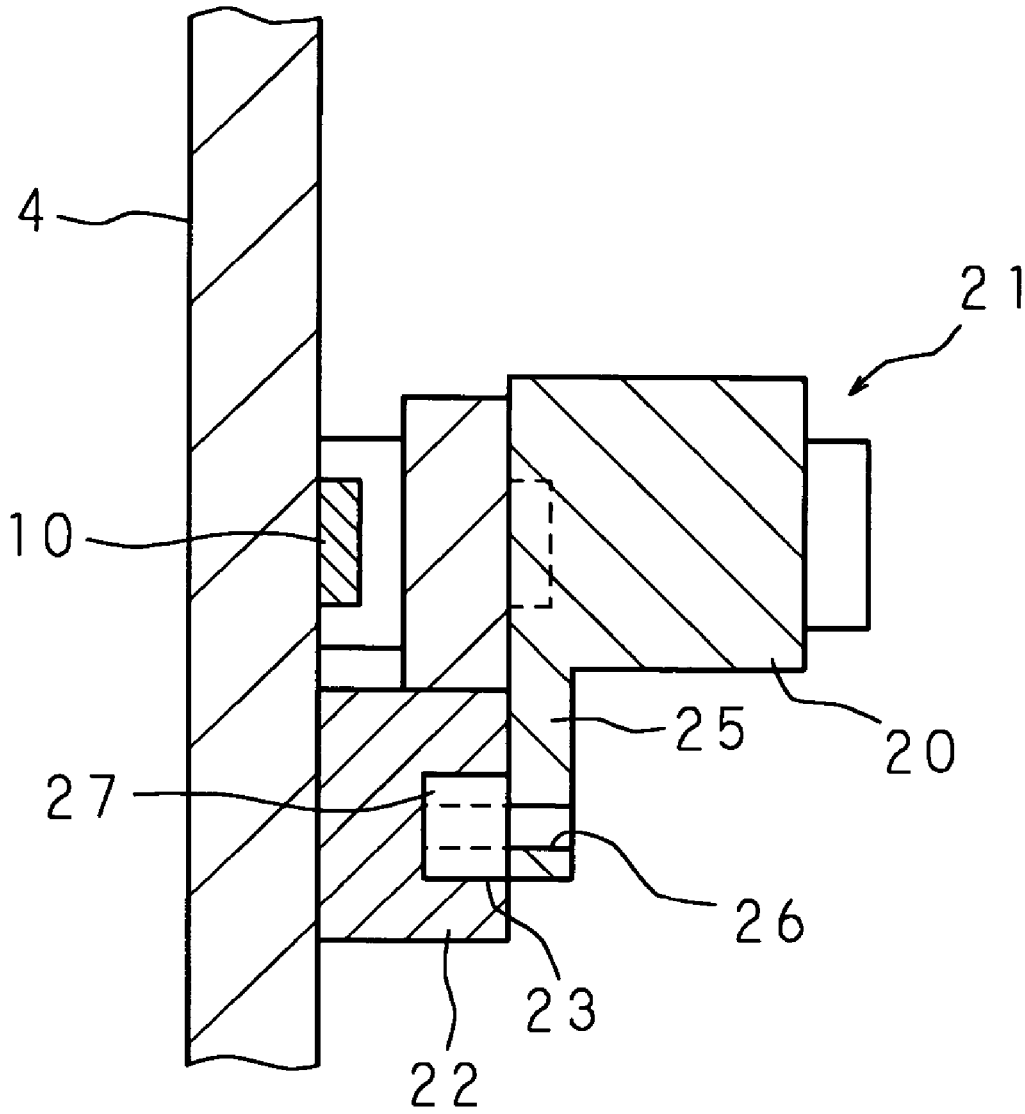
FIG. 3 is a fragmentary cross-sectional view showing a structure of a cam mechanism.

FIG. 3 is a fragmentary cross-sectional view showing a structure of the cam mechanism 21. As shown in FIG. 3, the cam mechanism 21 is removably attached to the front wall 4, and includes a block 22 with a cam groove 23, a protruding piece 25 of the swinging member 20, and a slider 27 pivotally fitted in the cam groove 23 by an axle 26. The center line of the cam groove 23 is inclined counterclockwise by a predetermined acute angle $\alpha$ with respect to the moving direction of the first bending dice mounting slider 11. The slider 27 is of a size that does not create a play when fitted in the cam groove 23, and hence kept from rattling widthwise of the cam groove 23. At the end portion of the swinging member 20, the bending dice 13 is attached.

Figure 4:
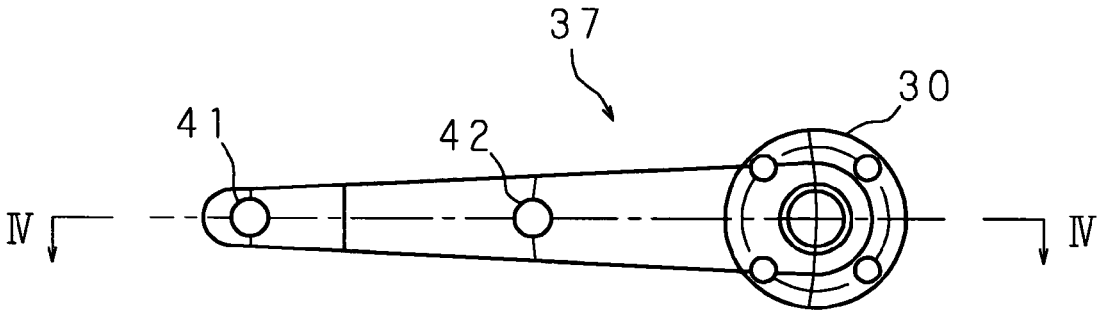
FIG. 4A is a plan view showing an arm.
FIG. 4B is a cross-sectional view taken along the line IV-IV of the arm.
Figure 4:
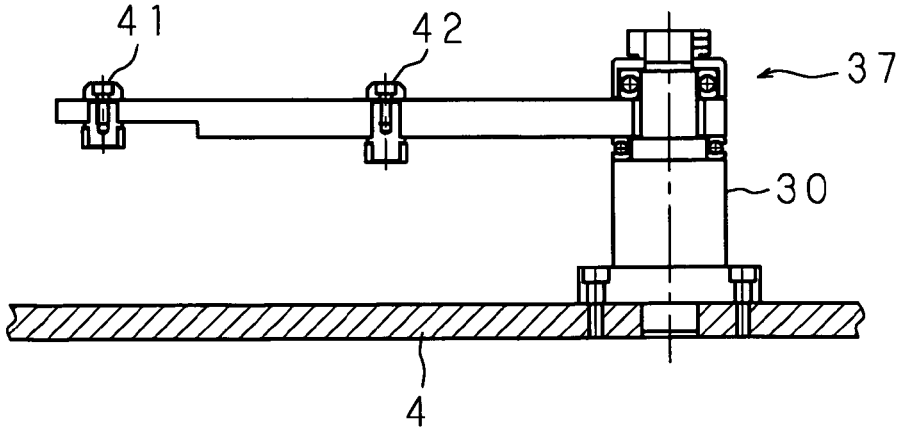

FIGS. 4A and 4B depict a structure of the arm 37, and FIG. 4A is a plan view of the same, while FIG. 4B is a cross-sectional view taken along the line IV-IV of the arm 37. The arm 37 is removably mounted on a base 30 fixed at a predetermined position on the front wall 4, so as to swing about the base 30 when mounted thereon.

The arm 37 includes the first projection 41 and the second projection 42, at an end portion thereof opposite to the base 30 and at a middle point therebetween respectively. The first projection 41 fits in a groove 34, 54 of the second bending dice mounting slider 32 or the third bending dice mounting slider 52, and the second projection 42 fits in the groove 14 of the first bending dice mounting slider 11.

FIG. 1 represents a state that the first projection 41 of the arm 37 is engaged with the third bending dice mounting slider 52, in which case the wire 1 is bent by the bending dices 13, 33 respectively attached to the first bending dice mounting slider 11 and the second bending dice mounting slider 32, and the third bending dice mounting slider 52 is not directly involved in the manufacturing of the spring. However, the first bending dice mounting slider 11 is caused to move by the driving source that drives the third bending dice mounting slider 52.

Figure 5:
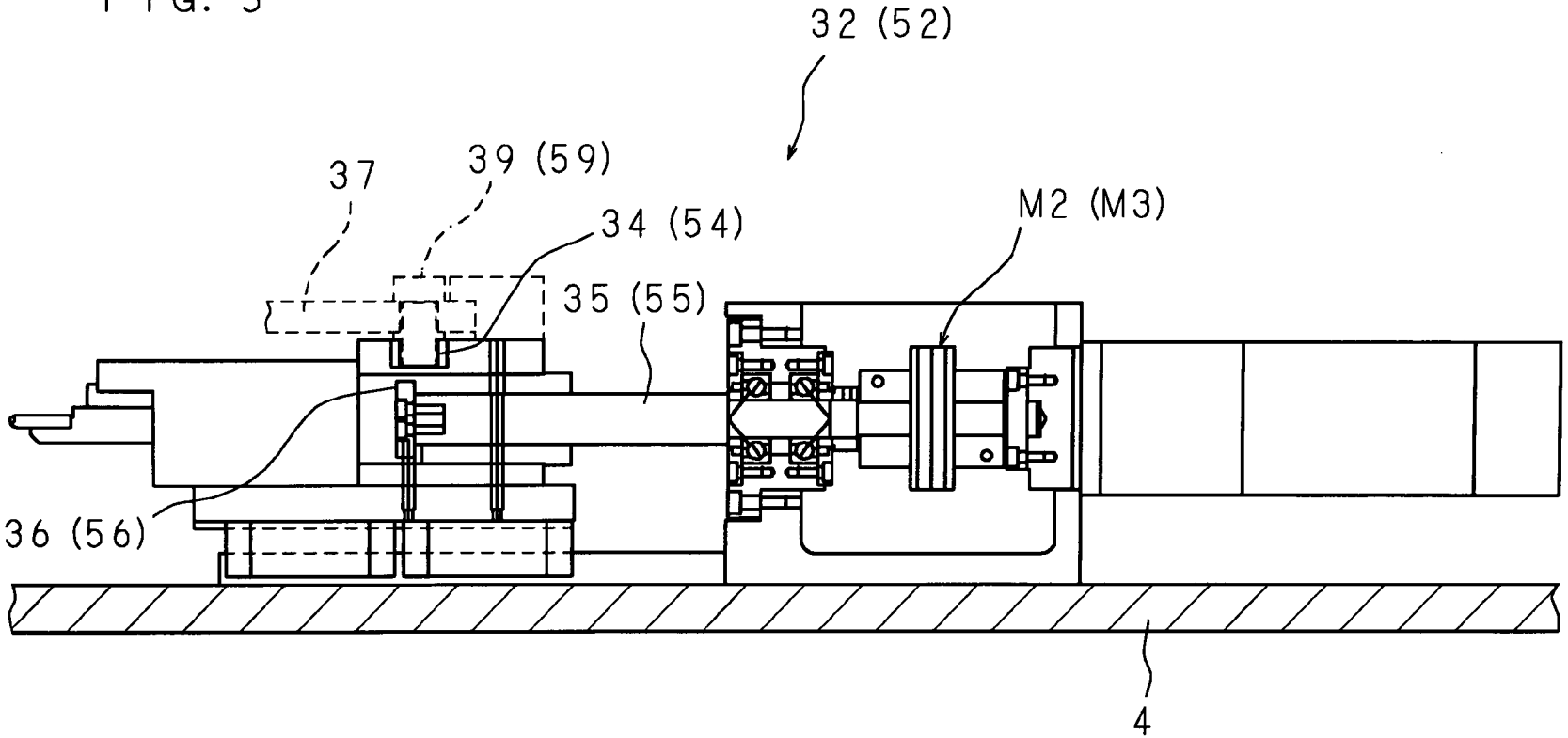
FIG. 5 is a cross-sectional view taken along the line V-V of FIG. 1, showing a structure of a second (third) bending dice mounting slider.

FIG. 5 is a cross-sectional view taken along the line V-V of FIG. 1, showing a structure of the second (third) bending dice mounting slider 32 (52). The second (third) bending dice mounting slider 32 (52) includes a guide rail 30 (50) inclined in a predetermined angle $\beta$ with respect to an extension of the center line of the wire 1 in a wire guide 3, so that the second (third) bending dice mounting slider 32 (52) can slide back and forth along the guide rail 30 (50)with respect to the wire processing space 5. In FIG. 1, the bending dice 33 is attached to the tip portion of the second (third) bending dice mounting slider 32 (52), but the bending dice 53 is not attached to the tip portion of the second (third) bending dice mounting slider 32 (52). Here, the second bending dice mounting slider 32 and the third bending dice mounting slider 52 are symmetrically located about a symmetry axis extended from the center line of the wire 1 in the wire path 2, at positions inclined by the predetermined angle $\beta$.

The second (third) bending dice mounting slider 32 (52) is provided with the motor M2 (M3) serving as the driving source that directly drives the second (third) bending dice mounting slider 32 (52). The first projection 41 at the end portion of the arm 37 is fitted in the groove 34 (54) of the second (third) bending dice mounting slider 32 (52), via an axle 39 (59). The axle 39 (59) slides along the groove 34 (54). This causes the second (third) bending dice mounting slider 32 (52) to slide in the predetermined angle $\beta$, so that the arm 37 swings thus to move the first bending dice mounting slider 11 in a predetermined direction, in an interlocked manner.

The motor M2 (M3) can rotate both in forward and reverse directions. A ball screw 35 (55) is attached to the rotating shaft of such motor M2 (M3) so as to convert the rotation of the shaft into linear motion along the center of axis, and a female-threaded piece 36 (56) that thread-fits with the ball screw 35 (55) is attached to the second (third) bending dice mounting slider 32 (52). Accordingly, the rotation of the motor M2 (M3) in the forward or reverse direction causes the ball screw 35 (55) to rotate, thus to move the second (third) bending dice mounting slider 32 (52) back and forth with respect to the wire processing space 5.

The spring manufacturing apparatus thus configured is operated as follows. The description given below refers to a case where the bending dices 13, 33 are respectively attached to the first bending dice mounting slider 11 and the second bending dice mounting slider 32, and the arm 37 connects the first bending dice mounting slider 11 and the third bending dice mounting slider 52 for manufacturing a spring with a progressively increasing outer diameter.

Before the wire 1 is supplied, the first bending dice mounting slider 11 and the second bending dice mounting slider 32 are located at an end portion on the left. When the wire 1 starts to be supplied, the motors M2, M3 receive a rotation instruction signal so as to rotate at a predetermined rotation speed. The rotation of the motor M2 causes the second bending dice mounting slider 32 to move upward to the left at the predetermined angle β. The rotation of the motor M3 causes the third bending dice mounting slider 52 to move downward to the right at the predetermined angle β, so that the arm 37 causes the first bending dice mounting slider 11 to move away from the wire processing space 5 and the bending dice 13 moves upward to the right along a line inclined by a predetermined angle γ.

Figure 6:
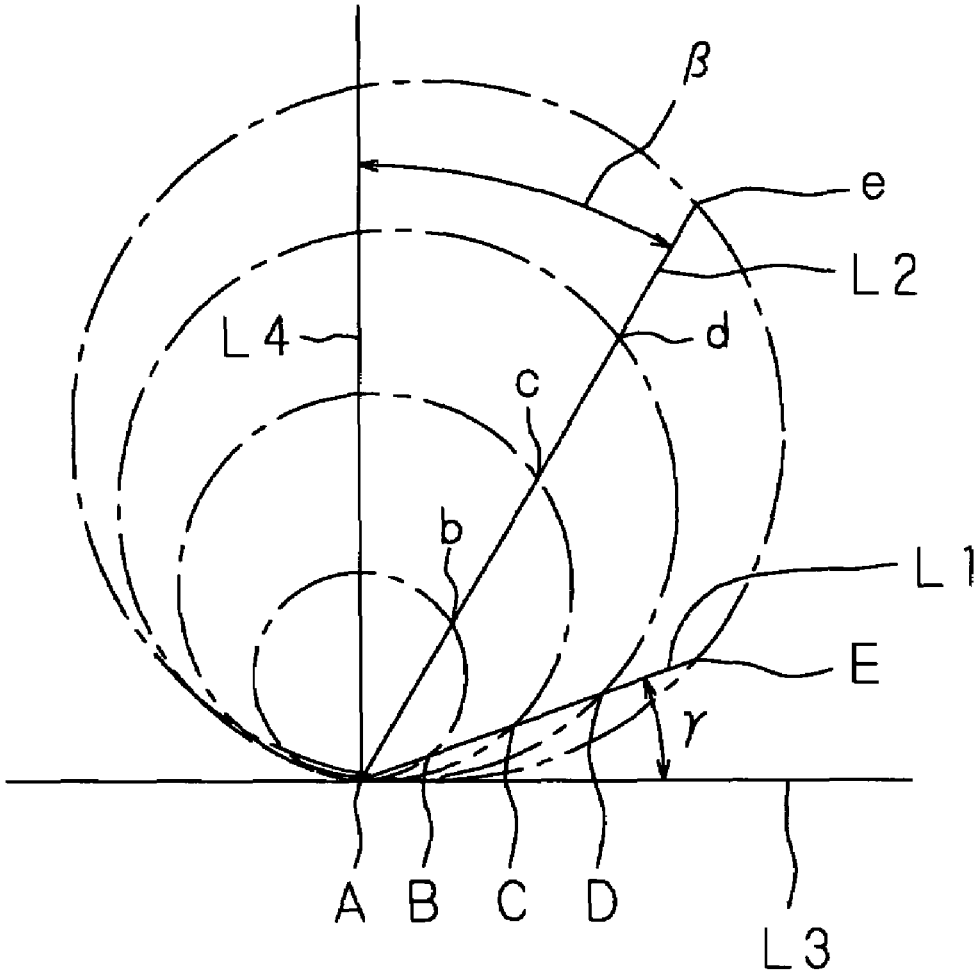
FIG. 6 is a graphic diagram showing moving directions of the first and the second bending dice mounting slider.

FIG. 6 is a graphic diagram showing moving directions of the first bending dice mounting slider 11 and the second bending dice mounting slider 32. The bending dices 13, 33 include a groove at a central portion thereof, for accurately bending the wire 1, and the central point P1 of the groove of the bending dice 33 moves along a line L1 shown in FIG. 6, and the central point P2 of the groove of the bending dice 13 moves along a line L2 in FIG. 6.

When the central point P1 moves for example to a position B, the central point P2 moves to a position b. Thus, the length, mounting position and shape of the arm 37, as well as the rotation speed of the motors M2, M3 are determined such that the both points linearly move interlocked with each other at a constant speed, maintaining a constant ratio between the travel distance of the central point P1 on the line L1 and that of the central point P2 on the line L2.

It is to be noted that in FIG. 6 a point A represents a lower end of the outlet of the wire 1 from the wire guide 3. A line L3 is a horizontal line, and a line L4 is a vertical line. The position of the bending dice 33 is determined according to an outer diameter of a coil portion of the spring to be wound, and at the same time the position of the bending dice 13 is also determined.

Moving thus the bending dices 13, 33 in an interlocked manner from the point A enables manufacturing a spring with a right-wound coil portion with a progressively increasing outer diameter. For manufacturing a spring with a left-wound coil, the arm 37 is removed, to then connect the first bending dice mounting slider 11 and the third bending dice mounting slider 52. The bending dice is replaced to the third bending dice mounting slider 52 from the second bending dice mounting slider 32, and the first bending dice mounting slider 11 and the third bending dice mounting slider 52 are moved interlocked with each other thus to manufacture a spring with a left-wound coil.

It should be noted that the direction of the center line of the cam groove 23 does not imperatively have to be linearly oriented in the direction rotated counterclockwise by the predetermined acute angle α from the moving direction of the first bending dice mounting slider 11. More broadly, forming the cam groove 23 in an arcuate shape with an appropriate rotation radius such that the bending dice 13 attached to the end portion of the swinging member 20 moves along a generally linear orbit allows moving the bending dice 13 along a line inclined upward by the predetermined angle α, according to a motion of the slider 27.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A spring manufacturing apparatus comprising:

a wire path through which a wire passes to enter a wire processing space for forming the wire into a spring by using a bending dice;

at least a pair of wire feeding rollers that pressingly holds the wire and feeds the wire to the wire processing space; and a first, a second and a third bending dice mounting slider disposed so as to move into and out of the wire processing space; in which the first bending dice mounting slider is located at a position opposing an outlet of the wire path, and the second and the third bending dice mounting sliders are symmetrically located with respect to a center line along the moving direction of the first bending dice mounting slider; further comprising:

an arm that mechanically connects the first and the second bending dice mounting slider, or the first and the third bending dice mounting slider selectively;

a first driving source that drives the second bending dice mounting slider;

and a second driving source that drives the third bending dice mounting slider; wherein one of the first and the second driving source, selected according to which bending dice mounting sliders are connected by the arm, causes the first bending dice mounting slider to move in an interlocked manner so as to determine a winding direction of the wire for manufacturing a spring.

2. The spring manufacturing apparatus according to claim 1, wherein the arm has a center of a swinging motion thereof on an extension of a line connecting the mechanically connected portion between the first and the second bending dice mounting slider, or between the first and the third bending dice mounting slider.

3. The spring manufacturing apparatus according to claim 1, in which the first bending dice mounting slider comprises a swinging member with a bending dice attached to an end portion, disposed so as to swing about the other end portion located close to a generally central portion of the first bending dice mounting slider;

a block with a cam groove formed above and below the first bending dice mounting slider; and a cam mechanism including a slider that fits in the cam groove; wherein one of the block and the slider is connected to the swinging member.

4. The spring manufacturing apparatus according to claim 2, in which the first bending dice mounting slider comprises a swinging member with a bending dice attached to an end portion, disposed so as to swing about the other end portion located close to a generally central portion of the first bending dice mounting slider;

a block with a cam groove formed above and below the first bending dice mounting slider; and a cam mechanism including a slider that fits in the cam groove; wherein one of the block and the slider is connected to the swinging member.

* * * * *